US007455188B2

(12) United States Patent
Kahlman et al.

(10) Patent No.: US 7,455,188 B2
(45) Date of Patent: Nov. 25, 2008

(54) LOAD HOIST ARRANGEMENT

(75) Inventors: Sture Kahlman, Vänersborg (SE); Johan Olsson, Amal (SE)

(73) Assignee: Kahlman Produkter AB, Vanersborg (SE)

( * ) Notice: Subject to any disclaimer, the term of this patent is extended or adjusted under 35 U.S.C. 154(b) by 255 days.

(21) Appl. No.: 10/548,539

(22) PCT Filed: Mar. 4, 2004

(86) PCT No.: PCT/SE2004/000299

§ 371 (c)(1),
(2), (4) Date: May 17, 2006

(87) PCT Pub. No.: WO2004/080880

PCT Pub. Date: Sep. 23, 2004

(65) Prior Publication Data

US 2007/0023379 A1 Feb. 1, 2007

(30) Foreign Application Priority Data

Mar. 10, 2003 (SE) ..... 0300638

(51) Int. Cl.
*B66C 11/16* (2006.01)

(52) U.S. Cl. ..... 212/321; 212/328

(58) Field of Classification Search ..... 212/321, 212/328

See application file for complete search history.

(56) References Cited

U.S. PATENT DOCUMENTS

| | | | | |
|---|---|---|---|---|
| 198,718 | A | 12/1877 | Weston | |
| 687,688 | A | 11/1901 | Kammerer | |
| 4,243,147 | A | 1/1981 | Twitchell et al. | |
| 4,370,932 | A | 2/1983 | Etcheparre et al. | |
| 5,804,932 | A | 9/1998 | Yanagisawa | |
| 7,043,337 | B2 * | 5/2006 | Colgate et al. | 700/213 |

FOREIGN PATENT DOCUMENTS

| | | |
|---|---|---|
| FR | 2 666 318 | 3/1992 |
| SE | 453 589 | 2/1988 |
| SE | 466 960 | 5/1992 |

* cited by examiner

*Primary Examiner*—Thomas J. Brahan
(74) *Attorney, Agent, or Firm*—Jeffrey S. Melcher; Manelli Denison & Selter, PLLC

(57) ABSTRACT

This invention relates to a load hoist arrangement (1) comprising a control device (50) arranged between a traverse device and a load carrying device (52). The load carrying device (52) is manually guidable in a three-dimentional space and lateral movement of said load carrying device (52) is controlled by a driving device. The driving device is controlled by recorded and transmitted force impacts from said control device (50) to said driving device. The traverse device has support elements (5, 6, 7) for supporting a traveling bridge (4), arranged to travel along said support elements (5, 6, 7), and a carriage (3) arranged to travel back and forth on said traveling bridge (4). The driving device comprises at least one motor, provided with at least two driving wheel units (15, 16), secured to said carriage (3) and two drag elements (21, 21') secured at its end portions to opposite end portions of said support elements (5, 6) and crossing at said traveling bridge (4). The drag elements (21, 21') crossing each other at said carriage (3) arranged such that a first driving wheel unit (15) works in contact with one drag element (21) and a second driving wheel unit (16) works in contact with another drag element (21'), thereby moving the carriage (3) and hence the load carrying device (52) in the lateral direction during operation.

14 Claims, 7 Drawing Sheets

LOAD HOIST ARRANGEMENT

FIELD OF THE INVENTION

The present invention relates to a load hoist arrangement comprising a control device arranged between a traverse device and a load carrying device, wherein said load carrying device is manually guidable in a three-dimensional space, and wherein lateral movement of said load carrying device is controlled by a driving device, said driving device is controlled by recorded and transmitted force impacts from said control device to said driving device, and wherein said traverse device having support elements for supporting a traveling bridge arranged to travel along said support elements and a carriage arranged to travel back and forth on said traveling bridge.

TECHNICAL BACKGROUND

There exist in the prior art an arrangement of the kind referred to above which permits the drive of the load carrying device to be influenced in the lateral sense through a lateral movement of a lifting cable. When lifting something using such prior art load hoist arrangements there is often a problem with self-induced vibrations or excessive swinging in the load hoist arrangement. The changes in acceleration and direction, induced manually by an operator, to the load carrying device often makes the load carrying device start swinging. Once it has started swinging, especially if the load is heavy, it is difficult to stop the motion and sometimes the supporting structure will follow swinging, leading to e.g. a decrease in maneuverability, a risk for accidents, etc.

In SE 466 960 a load hoist arrangement is presented having a traverse device comprising support elements for supporting a traveling bridge arranged to travel along said support elements and a carriage arranged to travel back and forth on said traveling bridge. Two motors are arranged on the support structure and provided with cables connected to the traveling bridge, which bridge is located between the motors, for the purpose of driving said traveling bridge in each of its mutually opposite directions along the support structure. There is also a need for a load hoist arrangement which supports motions in a lateral plane and not only along a line.

By positioning the motors on the support structure, a relatively stable working environment for the heavy motors is accomplished. However, these motors need to communicate with the transmitters arranged on preferably the moving parts of the load hoist arrangement in order to perform a controlled movement. Thus, there are a lot of cables interconnecting static components with movable parts on such prior art load hoist arrangements. These cables are often provided with sensitive connections and couplings, which in this dynamic environment will be quite exposed to wear, providing a risk for e.g. less accurate motion control and an increasing need for maintenance. In addition there is also a need for a load hoist arrangement which is easy and fast to install.

SUMMARY OF THE INVENTION

The object of the present invention is to provide a load hoist arrangement that overcomes the above issues, and presents a solution which is capable of handling the manually induced accelerations, maintaining stability in the load hoist arrangement even when handling heavy goods.

A further object of the present invention is to provide a load hoist arrangement which is easy and fast to install. It is still a further object to provide a load hoist arrangement which is excellent in control and maneuverability both in the lateral and vertical direction and hence present a load hoist arrangement, which allows for sound working conditions and enable support during heavy and/or complicated lifting operations.

These and other objects are achieved by a load hoist arrangement according to claim 1. Preferred embodiments of the invention are defined in the dependent claims 2-12. According to the invention there is provided a load hoist arrangement comprising a control device arranged between a traverse device and a load carrying device, wherein said load carrying device is manually guidable in a three-dimensional space, and wherein lateral movement of said load carrying device is controlled by a driving device, said driving device is controlled by recorded and transmitted force impacts from said control device to said driving device, wherein said traverse device having support elements for supporting a traveling bridge arranged to travel along said support elements and a carriage arranged to travel back and forth on said traveling bridge, characterized in that said driving device comprises at least one motor, provided with at least two driving wheel units (15, 16), secured to said carriage and two drag elements secured at its end portions to opposite end portions of said support elements and crossing at said traveling bridge, wherein said drag elements crossing each other at said carriage arranged such that a first driving wheel unit works in contact with one drag element and a second driving wheel unit works in contact with another drag element, thereby moving the carriage and hence the load carrying device in the lateral direction during operation, wherein the drag elements, on respective end portion of said traveling bridge, are arranged at least partly around an axle unit from different directions.

The inventive driving device is easy to manufacture and install since the carriage can be made in a standardized manner and the support structure together with the drag elements are simple to adapt to suit the location in question. Furthermore, the need for providing the whole arrangement with cables transmitting control data is reduced to a zone within proximity to the carriage. This in. turn reduces the need for providing the arrangement with cable racks, interconnecting e.g. motors and sensors, adapted to follow the traverse device and yet maintain contact to the interconnected components. Since it is a dynamic system, often covering a large working area, and frequently used, the risk for play in the connections of the control system interconnecting, e.g. motors, transmitters and recording sensors may lead to downtime and reduced productivity. Hence, the load hoist arrangement according to the invention is also less sensitive to such incidents.

Preferably, the load hoist arrangement according to the invention has a driving device which comprises two motors each provided with a driving wheel unit. By using two motors in the driving device the load hoist arrangement according to the invention will respond quickly to any given input data for maneuvering the load hoist arrangement.

In accordance with a preferred embodiment the drag elements, on respective end portion of said traveling bridge, are arranged at least partly around an axle unit from different directions. This arrangement provides for stability, smoothness and precision in the movement of the traverse device. The increased stability achieved by using this principle provides for a surprisingly controlled movement of the traverse device even when exposed to heavy loading and sudden accelerations. Furthermore, the increased stability of the structure allows for a controlled motion of a carriage and hence allows for securing at least one motor to the carriage for enabling lateral movement of the traverse device.

Preferably, the drag elements, on respective end portion of said traveling bridge, are arranged at least partly around an axle unit from different directions and in separate grooves.

More preferably, the drag elements, on respective end portion of said traveling bridge, are preferably arranged in a generally ninety degree turn around an axle unit from different directions and in separate grooves. By this arrangement possible imperfections will be almost automatically corrected due to the co-working geometry of the drag element pattern.

According to a preferred embodiment of the load hoist arrangement the drag elements are in non-slidable contact with the corresponding driving wheel unit and the axle unit, said axle unit comprising a rotatable wheel unit.

Further, the drag elements are secured tethered to at least one end portion of the support element.

Hence, a desired pretension in the system is accomplished. Advantageously, the load carrying device is connected to a hoist motor using a transmitter in the control device for controlled vertical movement of the load carrying device, said controlled vertical movement compensating for any load on the load carrying device so that an operator guiding the load hoist arrangement manually will experience merely a fraction of resistance. This embodiment provides for efficient and smooth operability, sparing difficult lifts for personnel involved with installation of the goods to be lift in.

According to a first embodiment of controlling the load hoist arrangement the angle of a load carrying element in a position control device is used as reference of force impact for guiding and controlling the driving device, and thus the load carrying device, in a lateral plane.

In accordance with a second alternative embodiment a vertically linear guide is provided with a control device comprising a sensor, preferably a load cell package (74), to be used as reference of force impact for guiding and controlling the driving device, and thus the load carrying device, in a lateral plane.

Preferably, said motors are capable of clockwise and counterclockwise turning, which in combination with the inventive pattern of the drag elements provide for that the load hoist arrangement according to the invention will be able to operate in a stable manner, covering a large surface area.

BRIEF DESCRIPTION OF THE DRAWINGS

A currently preferred embodiment of the present invention will now be described in more detail, with reference to the accompanying drawings, in which.

DETAILED DESCRIPTION OF PREFERRED EMBODIMENTS

A first embodiment of the invention related to a load hoist arrangement will be described in more detail in the following with reference to the accompanying drawings.

Figure 1:
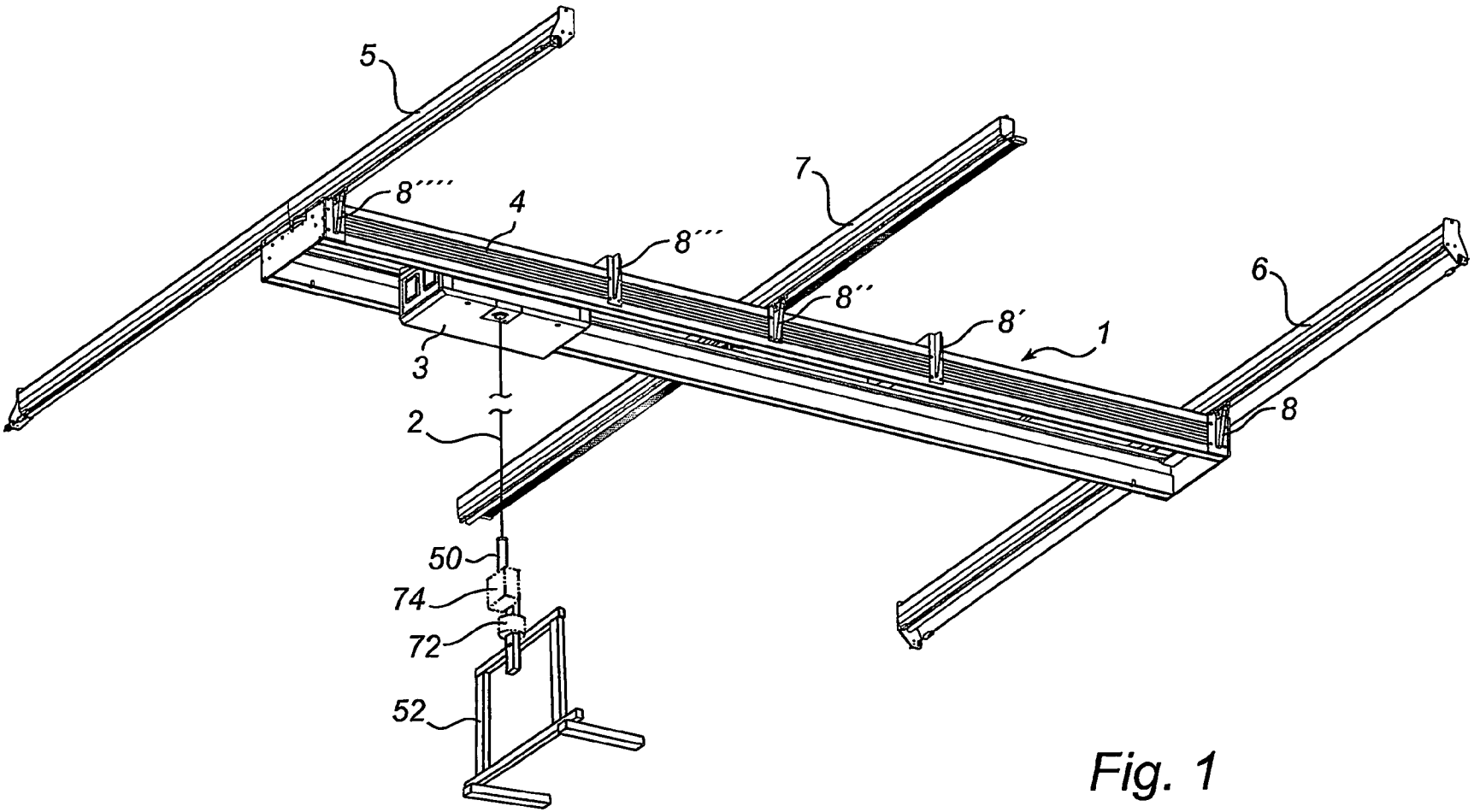
FIG. 1 is a perspective view of an example of a load hoist arrangement according to an embodiment of the invention.

Referring now to FIG. 1, wherein a load hoist arrangement 1 according to the invention is shown. A control device 50 is arranged along a lifting cable 2 between a traverse device and a load carrying device 52. The load carrying device 52 is manually guidable in a three-dimensional space. Lateral movement of said load carrying device 52 is controlled by a driving device. The load carrying device 52, which is for example a hook, a magnet, a suction component etc., capable of being supported by a lifting cable 2. The driving device is controlled by recorded and transmitted force impacts from said control device 50 to said driving device.

Furthermore, said traverse device having support elements 5, 6, 7 for supporting a traveling bridge 4. The traveling bridge 4 is arranged to travel along said support elements 5, 6, 7. A carriage 3 is in turn arranged to travel back and forth on said traveling bridge 4. The traveling bridge 4 and the carriage 3 are suitably provided with guide wheels, runners or other roller or slide devices for enabling horizontal movement.

Figure 2:
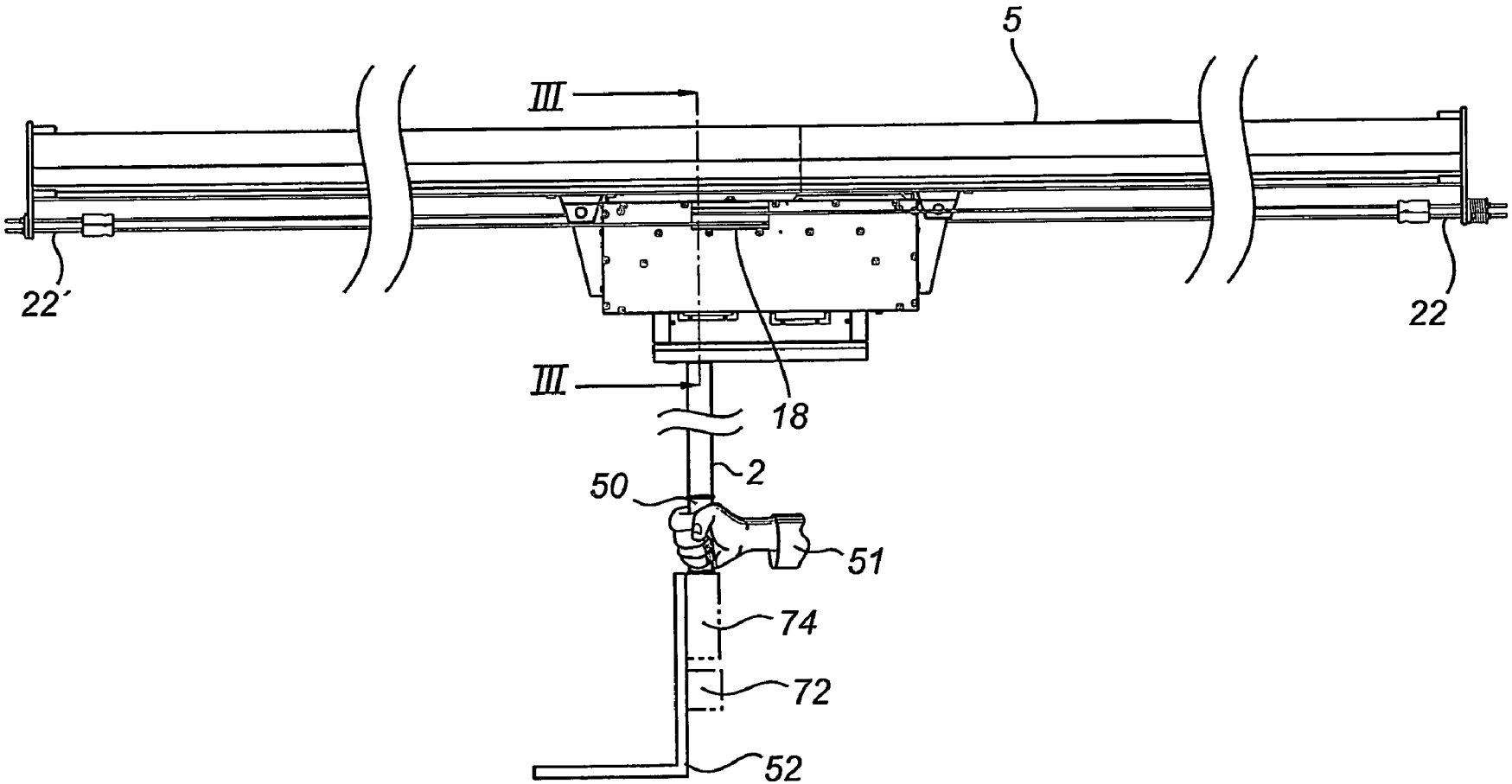
FIG. 2 is a side view of FIG. 1.
Figure 4:
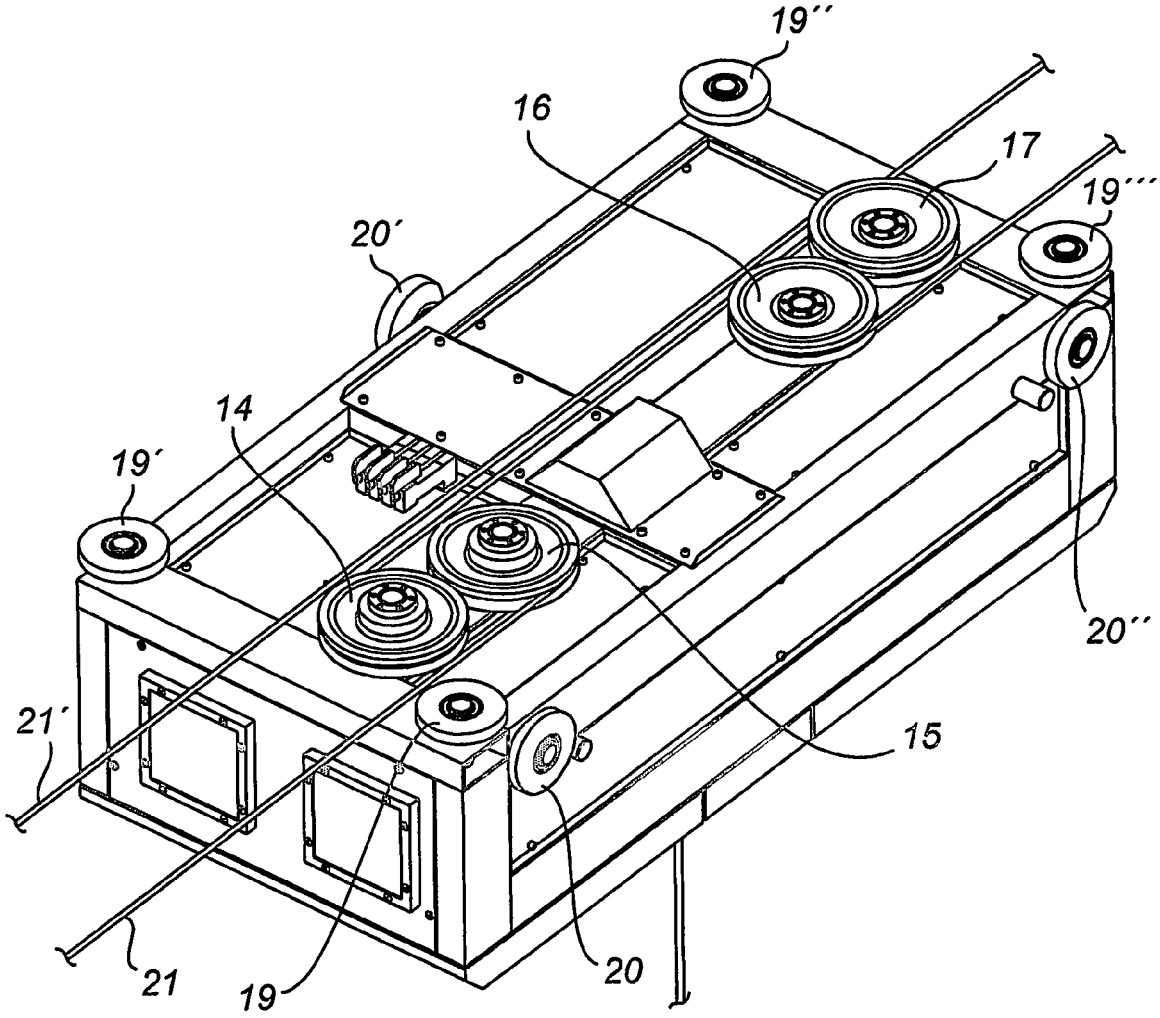
FIG. 4 is a partial perspective top view of a carriage in accordance with an embodiment of the invention.
Figure 5:
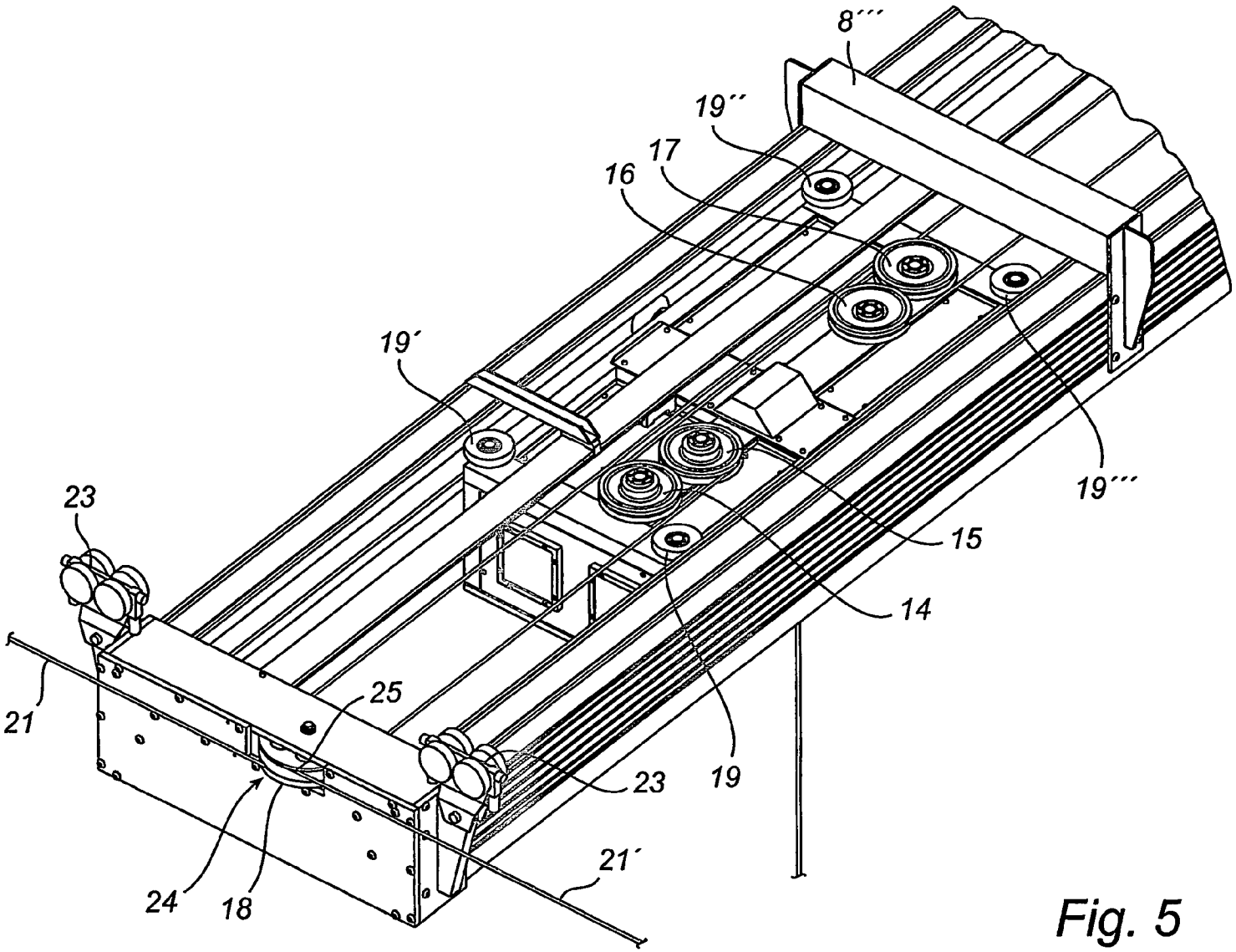
FIG. 5 is a partial perspective top-view of a carriage provided in a traveling bridge in accordance with an embodiment of the invention.

Referring now to FIG. 2, wherein an operator 51 is guiding the load carrying device 52. The driving device preferably comprises two motors (not shown in FIG. 2) secured to said carriage 3. Further with reference to FIG. 4, two drag elements 21, 21' are secured at its end portions to opposite end portions of said support elements 5, 6 and crossing at said traveling bridge 4. The drag elements 21, 21' crossing each other at said carriage 3 such that a driving wheel unit 15, 16 of one motor 10, 11 works in contact with one drag element 21, 21'. In proximity to each of the driving wheel units 15, 16 is a guide wheel unit 14, 17 located in a freewheeling manner in order to guide the drag elements 21, 21' in a desired path. Guide rollers 19, 19', 19", 19'"; 20, 20', 20", 20'", are provided on the carriage for enabling movement of the carriage along the traveling bridge 4.

Figure 8:
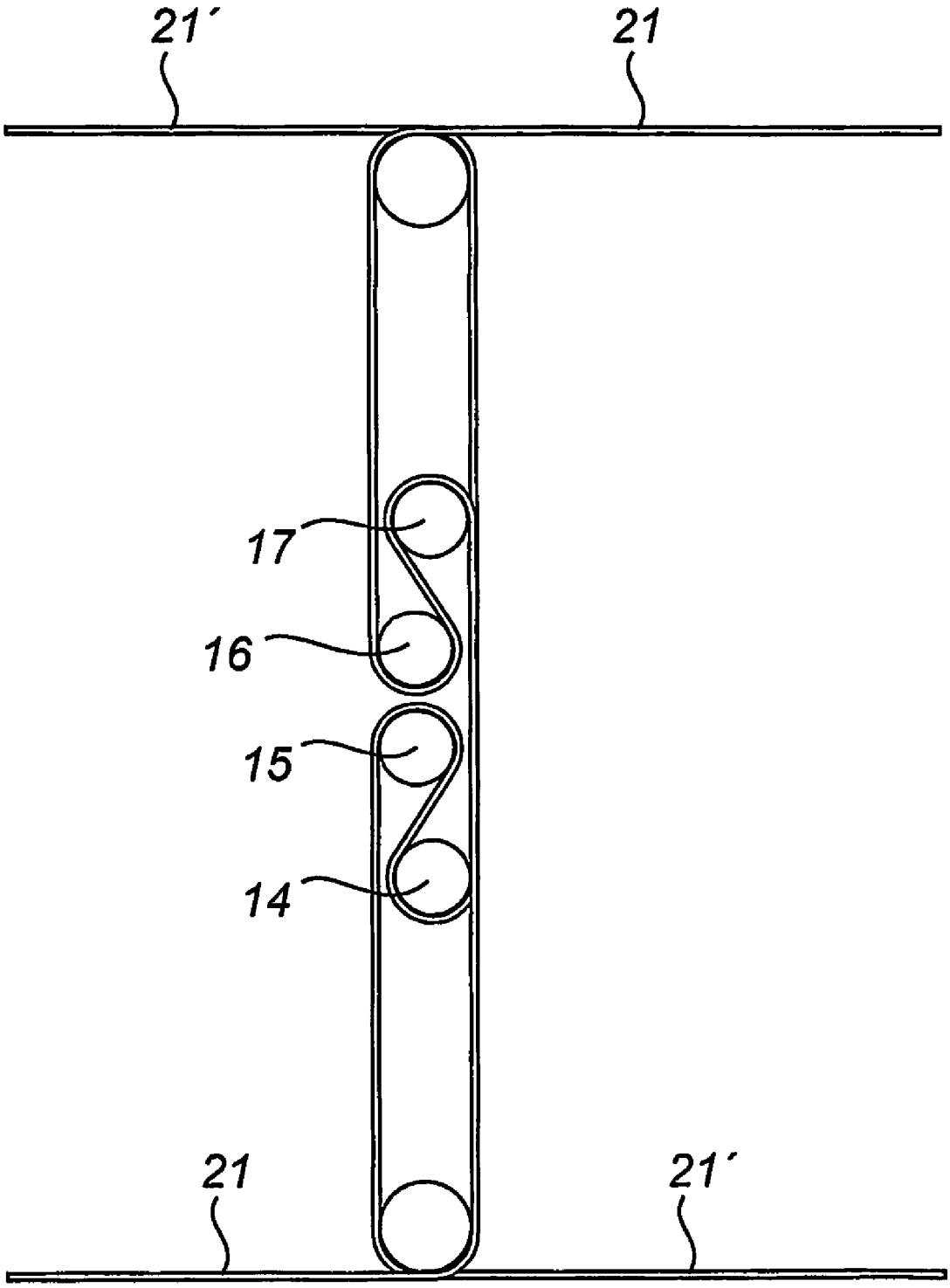
FIG. 8 is a schematic top-view of the drag element path of the present invention.

With reference to FIG. 1-5 and possibly best illustrated by FIG. 8, the path of one drag element 21, 21' will be described. The drag element 21, 21' path starts in one end portion of a support element 5, 6, where the drag element is secured by a spring unit 22 or the like in order to maintain a desired pretension in the driving device. The drag element 21, 21' then continues to an axle unit 18 which is located on the respective end portion of the traveling bridge 4, where the path turns about 90 degrees and progresses further along the traveling bridge 4 and around one driving wheel 15, 16 and one guide wheel 14, 17. After having described this almost 8-shaped path the drag element 21, 21' progresses to the other axle unit 18 where it makes a new 90 degree turn and continues towards opposite end of the other support element 5, 6 in relation to where the drag element 21, 21' started the path. The other drag element 21, 21' describes a corresponding path although starting and ending in the two other corners of the operation area of the load hoist arrangement 1. The axle unit 18 has two separate grooves, one for each drag element 21, 21'. The combination of the two drag element paths makes the axle unit 18 locked from two directions providing the driving device with increased stability.

According to one embodiment of the invention the drag element 21, 21' is a line or similar made of polyamide. One example of a useful polyamide is a polyamide with para structure. The material properties of the drag element will then assure for suitable tension in the system as well as consistent characteristics with respect to fatigue. The friction between the drag element and possible guide wheels 14, 17, axle units 18, and driving wheel units 15, 16 together with the drag element path will prevent the drag element from sliding when the driving device is in operation. Thus, a stable performance of the traverse device is accomplished. According to an alternative embodiment (not shown) the drag element 21, 21' is a drive belt adapted to work in gripping contact with the driving wheel units 15, 16. In accordance with a second alternative embodiment the drag element 21, 21' is made of steel wire suitable for non-slidable contact with the driving wheel units 15, 16.

The carriage 3 is thus moved by actuation of the two motors 10, 11 and hence the load carrying device 52 will follow. The motors 10, 11 are capable of clockwise and counterclockwise turning providing for that two motors 10, 11 in combination with the drag element paths described above will be sufficient to cover an operating area in the horizontal plan defined by outer support elements 5, 6 and their respective end portions.

Figure 3:
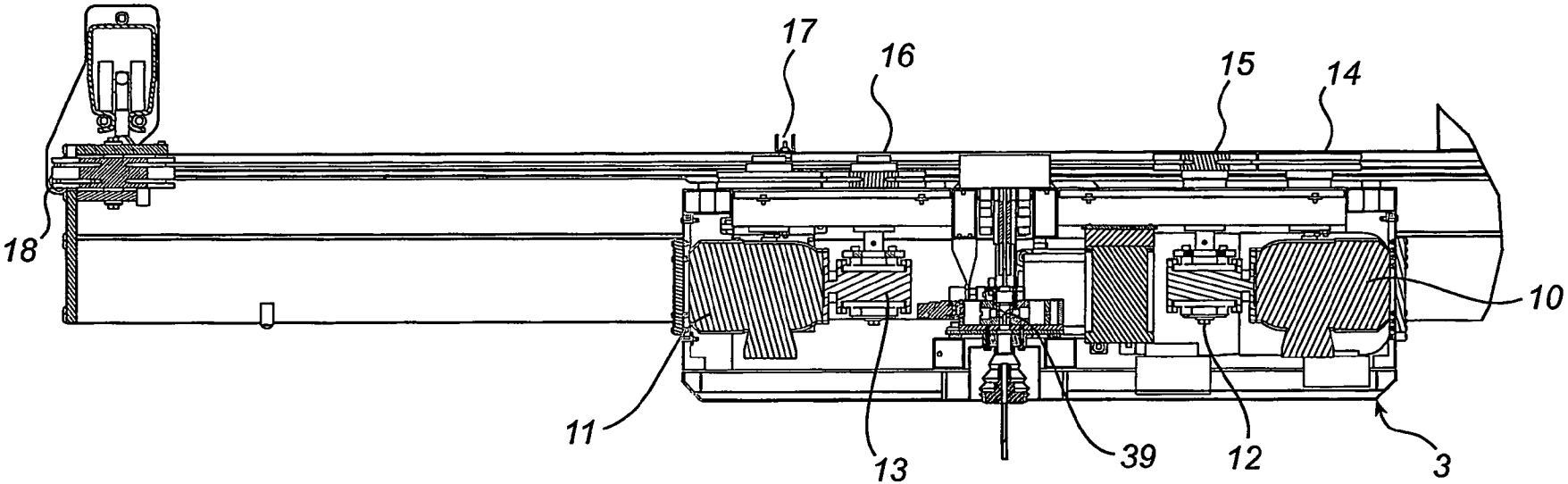
FIG. 3 is a sectional side-view taken along III-III in FIG. 2.

As can be seen in FIGS. 2 and 3, the load carrying device 52 is connected to a hoist motor 71 using a transmitter in the control device 50 for controlled vertical movement of the load carrying device 52. This hoist motor 71 is capable of clockwise and counterclockwise turning. Preferably, a moment motor is used. The principal for the controlled vertical movement compensating for any load on the load carrying device 52 is outlined in for example patent application SE 8502716-7. The result of the transmitter and sensor system is that an operator 51 guiding the load hoist arrangement manually will experience merely a fraction of resistance in the vertical direction.

Figure 7:
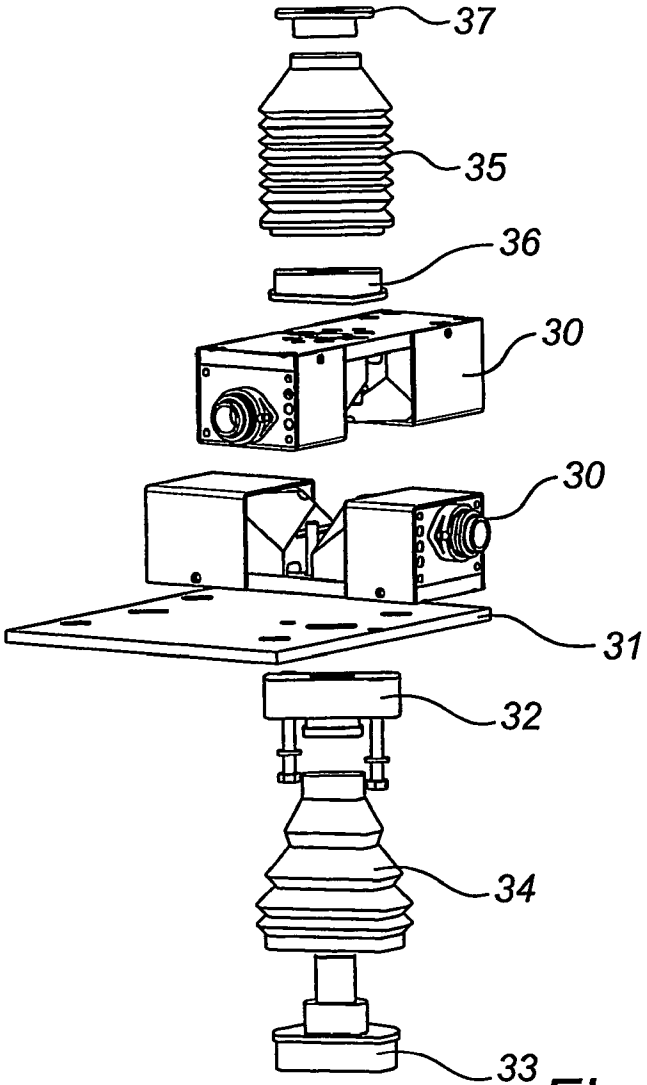
FIG. 7 is an exploded view of FIG. 6.
Figure 6:
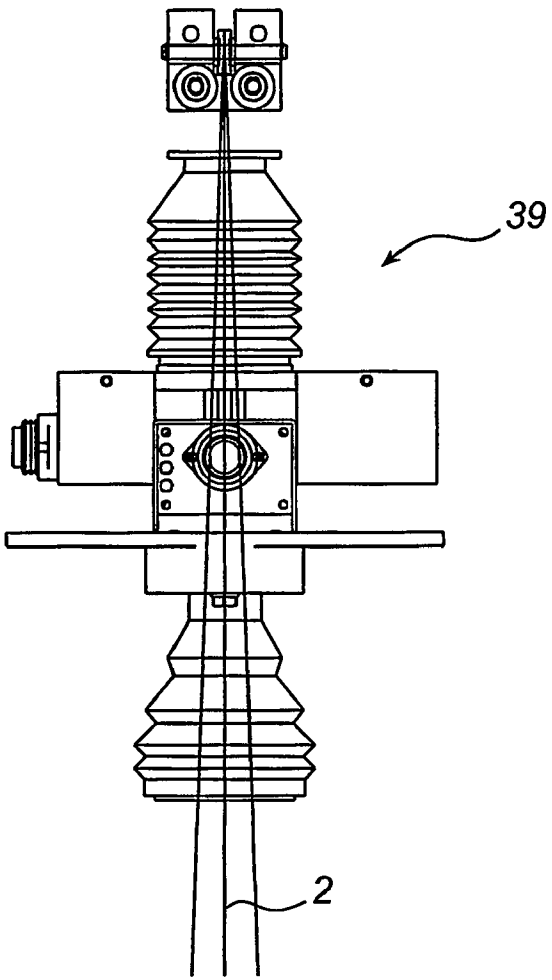
FIG. 6 is a partial side-view of a first embodiment of the present invention.

In addition, and in order to facilitate vertical movement, the present load hoist arrangement provides a unique stability and maneuverability due to the inventive driving device of the traverse device. According to a first embodiment of the invention shown in FIGS. 6 and 7, the angle of a load carrying element 2 is used as reference of force impact for guiding and controlling the driving device, and thus the load carrying device 52, in a lateral direction. Hence, the movement of the traverse device is proportional to the force applied manually by the operator and a controlled movement of the load carrying device 52 is accomplished relieving the operator from carrying the actual loading of the goods and yet being able to lift and move the goods.

According to a second alternative embodiment of the invention the load hoist arrangement (not shown) is controlled by a vertically linear guide having a control device comprising a sensor, preferably a load cell package 74, which is used as reference of force impact for guiding and controlling the driving device, and thus the load carrying device, in the lateral direction. In this case the shear of the linear guide is recorded and transmitted to the driving device and also to the load hoist motor for enabling controlled movement of the load hoist arrangement 1. The load cell arrangement is suitable especially when a linear guide is used. The linear guide is stiff against torque.

According to a third alternative embodiment of the invention the load hoist arrangement comprises a driving device of alternative configuration and function. Instead of two motors, for controlling the lateral movement as previously described, one motor is used for enabling movement in the lateral plane. Such motor will be provided with two driving wheel units 16, 16 which preferably are activated one at the time. Thus, the enabled movement of the load carrying device for such an embodiment of the inventive load hoist arrangement 1 is generally in orthogonal directions. Alternatively, the movement from A to B, if not in line with an orthogonal axis, is accomplished in small steps in a zigzag pattern. The movement of the traverse device is accomplished by letting one of the driving wheel units 15 of the motor work together with a drag element 21, while the other driving wheel 16 unit is free-wheeled. The activation of either driving wheel unit 15, 16 is accomplished by a control function using recorded impact data.

Although the present invention has been described in connection with particular embodiments thereof, it is to be understood that various modifications, alterations and adaptations may be made by those skilled in the art without departing from the spirit and scope of the invention. It is realized that various drag elements may be used e.g. a line, a cable, a drive belt, a wire, a chain etc. The material of the drag elements 21, 21' may also be altered depending on specific design criteria. Features from various described embodiments may be combined in order to realize further embodiments within the scope of the claimed invention.

The invention claimed is:

1. A load hoist arrangement comprising:

a traverse device comprising at least a first outer support element and a second outer support element with any additional support elements disposed between the first and second outer support elements, each of the support elements having corresponding first and second end portions;

a travelling bridge movably connected to the support elements so that the travelling bridge can travel back and forth along the support elements, the travelling bridge having first and second end portions, the first end portion being movably mounted to the first outer support element and the second end portion being movably mounted to the second outer support element;

a first axle unit rotatably mounted at the first end portion of the travelling bridge;

a second axle unit rotatably mounted at the second end portion of the travelling bridge;

a carriage movably connected to the travelling bridge so that the carriage can travel back and forth along the travelling bridge;

a first drive wheel rotatably mounted on the carriage;

a first guide wheel rotatably mounted on the carriage offset from the first drive wheel and between the first drive wheel and the first end of the travelling bridge;

a second drive wheel rotatably mounted on the carriage, wherein the second drive wheel is located closer to the second end of the travelling bridge than the first drive wheel;

a second guide wheel rotatably mounted on the carriage offset from the second drive wheel and between the second drive wheel and the second end of the travelling bridge;

at least one motor in communication with the first and second drive wheels to drive the first and second drive wheels;

a first drag element having an end mounted to the first end portion of the first outer support element, the first drag element bending around the first axle unit, the second guide wheel, the second drive wheel, and the second axle, another end of the first drag element being mounted to the second end portion of the second outer support element, wherein the first drag element bends in opposite directions on the first and second axle units and bends in opposite directions on the second drive and guide wheels;

a second drag element having an end mounted to the second end portion of the first outer support element, the second drag element bending around the first axle unit, the first guide wheel, the first drive wheel, and the second axle, another end of the second drag element being mounted to the first end portion of the second outer support element, wherein the second drag element bends in opposite directions on the first and second axle units and bends in opposite directions on the first drive and guide wheels; and wherein the first and second drag elements bend in opposite directions on the first and second axle units;

a hoist mounted to the carriage;

a load carrying device movably mounted to the hoist so that the load carrying device can be raised and lowered by the hoist; and a control device arranged between the hoist and load carrying device, the control device being in communication with the at least one motor, the control device constructed and arranged to measure impact force and control the at least one motor based on the measured impact force, wherein said load carrying device is manually guidable in a three-dimensional space.

2. The load hoist arrangement according to claim 1, wherein the at least one motor comprises a first motor in communication with the first drive wheel and a second motor in communication with the second drive wheel.

3. The load hoist arrangement according to claim 1, wherein the first and second drag elements are arranged in separate grooves on the first and second axle units.

4. The load hoist arrangement according to claim 1, wherein the first and second drag elements are arranged in a generally ninety degree turn around the first and second axle units and in separate grooves on the first and second axle units.

5. The load hoist arrangement according to claim 1, wherein the first drag elements is in non-slidable contact with the second drive wheel and the second drag element is in non-slidable contact with the first drive wheel.

6. The load hoist arrangement according to claim 1, wherein the first and second drag elements are in non-slidable contact with the first and second axle units.

7. The load hoist arrangement according to claim 1, wherein the control device is in communication with the hoist for controlled vertical movement of the load carrying device, said controlled vertical movement compensating for any load on the load carrying device so that an operator guiding the load hoist arrangement manually will experience merely a fraction of resistance.

8. The load hoist arrangement according to claim 1, wherein an angle of a load carrying element in the control device is used as reference of force impact for guiding and controlling the at least one motor, and thus the load carrying device, in lateral directions.

9. The load hoist arrangement according to claim 1, wherein the at least one motor can perform clockwise and counterclockwise turning.

10. The load hoist arrangement according to claim 1, wherein the first and second drag elements are in non-slid able contact with at least one of the components in the group of driving wheels, axle units and guide wheels.

11. The load hoist arrangement according to claim 1, wherein the first and second drag elements comprise a steel wire or cable.

12. The load hoist arrangement according to claim 1, wherein the first and second drag elements comprise a polyamide.

13. The load hoist arrangement according to claim 1, wherein the first and second drag elements are pretensioned.

14. The load hoist arrangement according to claim 1, wherein the movement of the carriage is proportional to the force applied manually by an operator to the control device.

* * * * *